US011644260B1

(12) United States Patent
Douvier

(10) Patent No.: US 11,644,260 B1
(45) Date of Patent: May 9, 2023

(54) METHOD AND APPARATUS FOR CONVERTING AN AR-15 FIREARM INTO A BULLPUP CONFIGURATION

(71) Applicant: Ryan Douvier, Edgerton, KS (US)

(72) Inventor: Ryan Douvier, Edgerton, KS (US)

( * ) Notice: Subject to any disclaimer, the term of this patent is extended or adjusted under 35 U.S.C. 154(b) by 0 days.

(21) Appl. No.: 17/732,861

(22) Filed: Apr. 29, 2022

Related U.S. Application Data

(63) Continuation-in-part of application No. 63/281,967, filed on Nov. 22, 2021.

(51) Int. Cl.
*F41A 11/02* (2006.01)
*F41A 19/10* (2006.01)

(52) U.S. Cl.
CPC ..... *F41A 11/02* (2013.01); *F41A 19/10* (2013.01)

(58) Field of Classification Search
CPC ..... F41A 11/02; F41A 11/00; F41A 19/10; F41A 19/09
See application file for complete search history.

(56) References Cited

U.S. PATENT DOCUMENTS

| | | | | |
|---|---|---|---|---|
| 8,931,393 | B1 * | 1/2015 | Vincent | F41A 17/46 89/27.3 |
| 9,677,846 | B1 * | 6/2017 | Vankeuren, III | F41A 17/46 |
| 2013/0185975 | A1 * | 7/2013 | Johnson | F41A 19/08 29/401.1 |
| 2014/0075803 | A1 * | 3/2014 | Muller | F41A 3/00 42/16 |
| 2014/0360076 | A1 * | 12/2014 | Zamlinsky | F41C 23/22 42/75.03 |

* cited by examiner

*Primary Examiner* — J. Woodrow Eldred
(74) *Attorney, Agent, or Firm* — Dale J. Ream

(57) ABSTRACT

A method for disassembling and converting a traditional AR-15 firearm into a bullpup configuration of an AR-15 firearm assembly includes releasing and removing at least a firearm but stock and a standard bolt carrier group from the AR-15 and then replacing the removed components with elements from a bullpup kit, namely a bullpup bolt carrier group that includes a bolt carrier and a spring assembly, the spring assembly having a plurality of radial spaced apart compression springs that are loaded when the bolt carrier recoils.

20 Claims, 14 Drawing Sheets

METHOD AND APPARATUS FOR CONVERTING AN AR-15 FIREARM INTO A BULLPUP CONFIGURATION

REFERENCE TO RELATED APPLICATIONS

This application is related to U.S. 63/281,967 filed on Nov. 22, 2021 titled Method and Apparatus for Converting an AR-15 Firearm into a Bullpup Configuration, which is incorporated by reference in its entirety.

BACKGROUND OF THE INVENTION

This invention relates generally to firearms and, more particularly, to an apparatus and method for converting an AR-15 rifle to a bullpup rifle configuration. The apparatus and method involve disassembling parts of the AR-15 firearm and coupling a kit of components, including a bullpup lower receiver and other components, to the disassembled AR-15.

A bullpup firearm rifle is a firearm with its action and magazine behind the trigger—the opposite of traditional rifle firearms. This configuration reduces the length of the firearm by about 25%, includes a more forward trigger, and is typically seen as being more maneuverable than a full-size rifle. A bullpup rifle may also have a shortened or removed butt stock. Many gun enthusiasts have a desire to have a bullpup firearm but find them hard to find to purchase. Alternatively, an existing rifle may be converted to a bullpup but may require complicated and extensive engineering to do so. However, enthusiasts of high-powered weapons may have an AR-15 and would find it desirable if the existing AR-15 could be easily modified into a bullpup configuration.

Therefore, it would be desirable to have a method and kit for disassembling portions of an AR-15 and assembling a bullpup firearm using parts of both the disassembled AR-15 and the bullpup kit.

SUMMARY OF THE INVENTION

Therefore, a method for disassembling and converting an AR-15 into the bullpup configuration of an AR-15 firearm assembly includes releasing and removing specific components of the AR-15 and then replacing the removed components with elements from the kit. Specifically, the standard buttstock of the AR-15 is removed and replaced with a bullpup buttstock. Further, the AR-15 bolt carrier group and buffer tube is removed and replaced with a bullpup bolt carrier group and buffer plug. Finally, the AR-15 trigger guard is removed and replaced with a trigger guard plate from the kit and which essentially covers the stock trigger which remains.

Then, additional elements of the bullpup assembly may be coupled to the modified AR-15 assembly. Specifically, the bullpup receiver (or sometimes called the lower receiver) is coupled to the barrel assembly of the modified AR-15 assembly, the bullpup lower receiver including a bullpup trigger portion. Then a trigger linkage is connected between the bullpup trigger portion and AR-15 stock trigger so that pulling the bullpup trigger simultaneously actuates the stock trigger to fire the firearm. The actual AR-15 trigger is hidden behind a pair of trigger guide plates and a side plate. The result is that the AR-15 is converted into a bullpup configuration. The method may be reversed without any damage or modification of the stock components of the unmodified AR-15 firearm.

Therefore, a general object of this invention is to provide a bullpup configuration of an AR-15 firearm assembly and a method for disassembling and converting an AR-15 into the bullpup configuration of an AR-15 firearm assembly.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
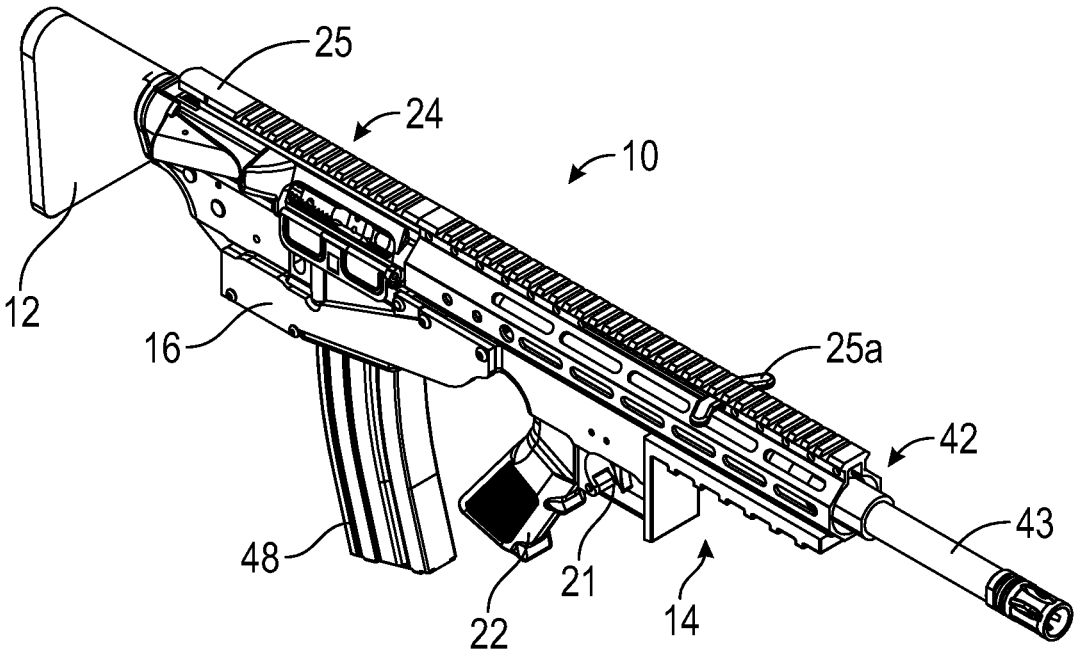
FIG. 1 is a perspective view of a bullpup assembly converted from an AR-15 firearm according to a kit and method of conversion according to a preferred embodiment of the present invention.
Figure 2A:
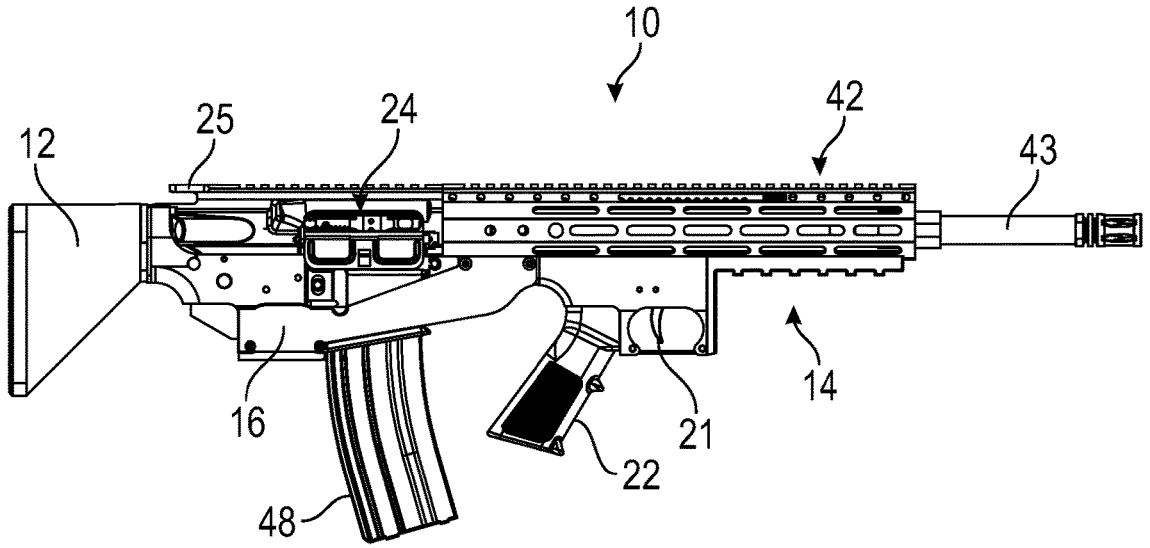
FIG. 2*a* is a side view of the bullpup assembly as in FIG. 1.
Figure 2B:
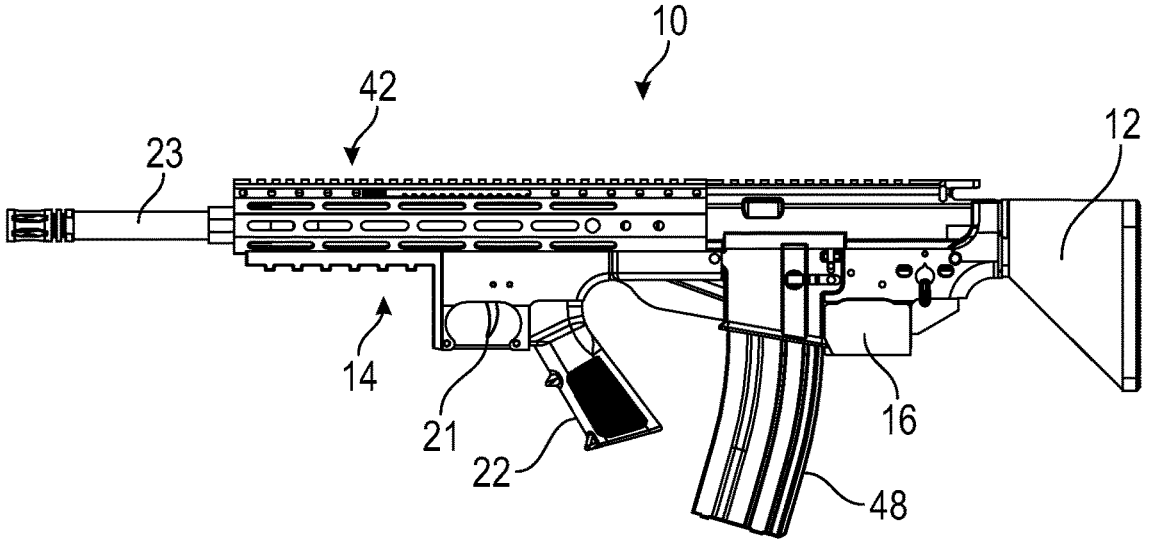
FIG. 2*b* is a reverse view of the bullpup assembly as in FIG. 2*a;*

A bullpup configuration of an AR-15 firearm assembly and a method for converting an AR-15 into the bullpup configuration of an AR-15 firearm assembly will now be described in detail with reference to FIGS. 1 to 14 of the accompanying drawings. Accordingly, a bullpup kit 10 includes a bullpup buttstock 12, a bullpup lower receiver 14, a side plate 16, a pair of trigger guard plates 18, 20 and a trigger linkage 30, and a modified bolt carrier group 24.

Figure 14:
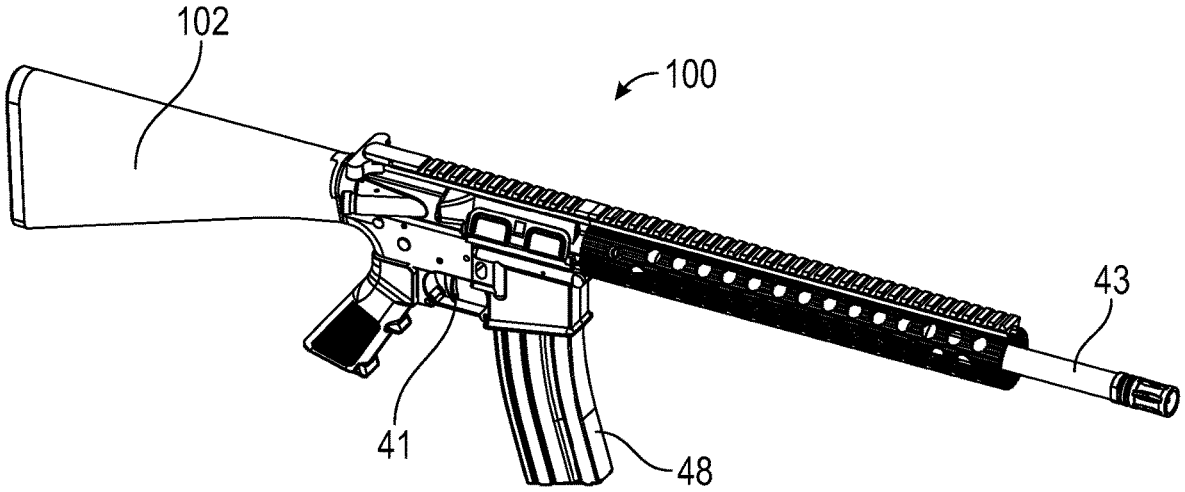
FIG. 14 is a perspective view of an unmodified AR-15 rifle.

The bullpup configuration of a modified AR-15 is shown assembled in FIG. 1 but will be first described according to a method for disassembling a standard configuration of an AR-15. It will be understood that several components of a standard AR-15 will remain after disassembly thereof for use with components of a bullpup kit 10 in order to form a fully assembled bullpup configuration of an AR-15. A standard unmodified AR-15 firearm is illustrated in FIG. 14.

In order to convert a standard configuration AR-15 to the bullpup configuration, certain components of the standard configuration AR-15 must be detached or uncoupled from the components that will remain and receive the components from the bullpup configuration. For instance, the standard AR-15 includes a buttstock 102 coupled to a rear end of an AR-15 body frame 40 (which is the lower receiver of the AR-15). The first step of the method of conversion is to uncouple the AR-15 buttstock 102 and to attach the AR-15 stock 12 in its place. It will be understood that components described may be coupled using pins, screws, or the like. Next, the standard AR-15 includes a trigger guard surrounding and protecting a standard AR-15 trigger 41 and this trigger guard or at least a bottom wall thereof is removed. This standard structure will be replaced by corresponding structures from the bullpup kit 10 as will be explained in greater detail later.

Figure 11:
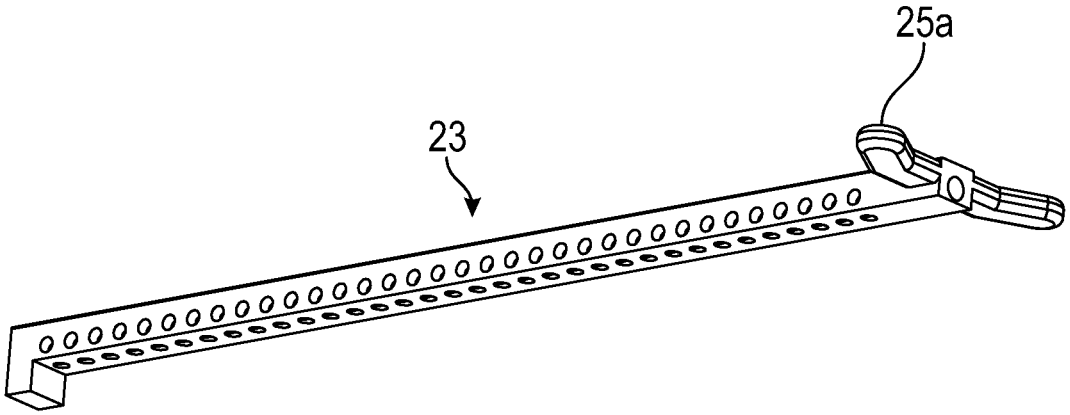
FIG. 11 is an isolated view of the forward charging handle removed from the assembly for clarity.

Further, it is desirable to remove the stock AR-15 bolt carrier group that fires and ejects bullets from the AR-15 and to replace it with a bolt carrier group 24 (or "BCG") and buffer plug from the bullpup kit 10. The bolt carrier group 24 may include a rear charging handle 25 that is operable to load a bullet casing into the chamber to be shot as is known in the art. In the stock AR-15, the bolt carrier group may include a rear charging handle 25 that may be alternately positioned to the rear or to the side of the bolt carrier group. However, the converted bullpup configuration will include a forward charging handle 25*a* that is positioned forward of the trigger, as will be described below and is shown in FIG. 11.

With the stock buttstock, stock trigger guard, and bolt carrier group removed, what is left will be referred to as a modified AR-15 assembly to which all elements of the bullpup kit 10 may be attached in replacement or in addition as described below.

The bullpup kit 10 includes a bullpup lower receiver 14 that provides the primary framework to which other components may be attached or that forms other components. More particularly, the bullpup receiver 14 includes an upper surface 15 (also referred to as the bullpup upper receiver) defining an elongate and generally planar surface that may be coupled to the body frame 40 (AR-15 lower receiver) of the modified AR-15 assembly. It is understood that the upper surface 15 may support a barrel assembly 42 of the modified AR-15 assembly and, more particularly, may include a silencer or sound suppressor coupled or positioned about the barrel. The bullpup receiver 14 may also be referred to as the lower receiver.

Figure 4A:
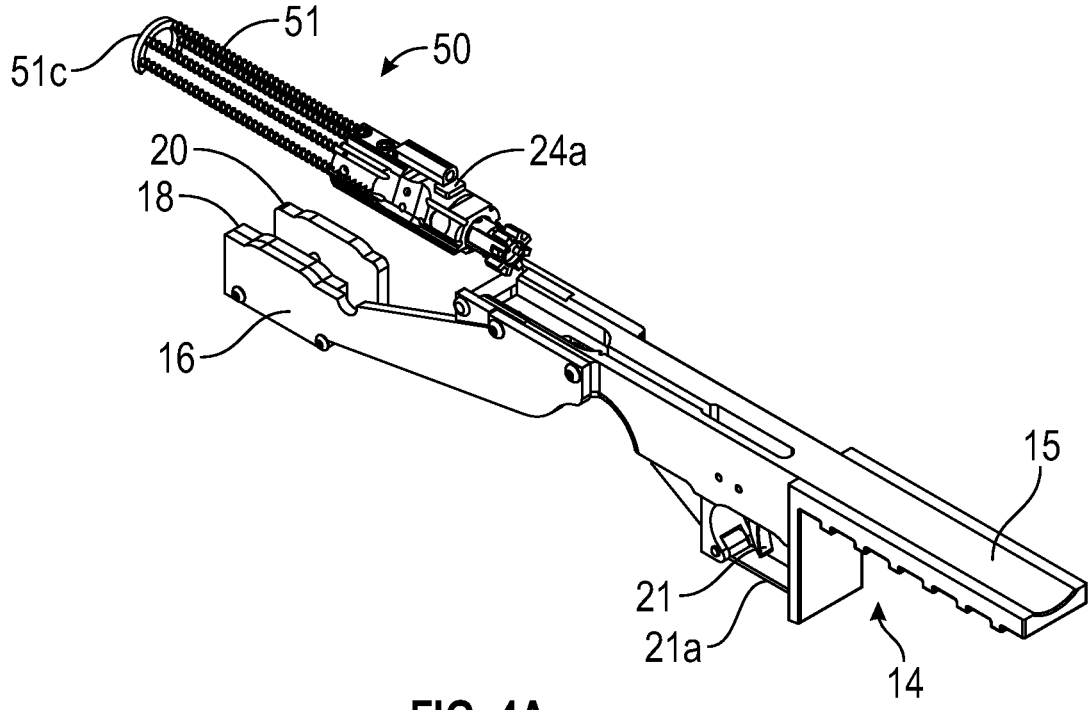
FIG. 4*a* is a perspective view of a portion of the bullpup assembly taken from FIG. 1.
Figure 4B:
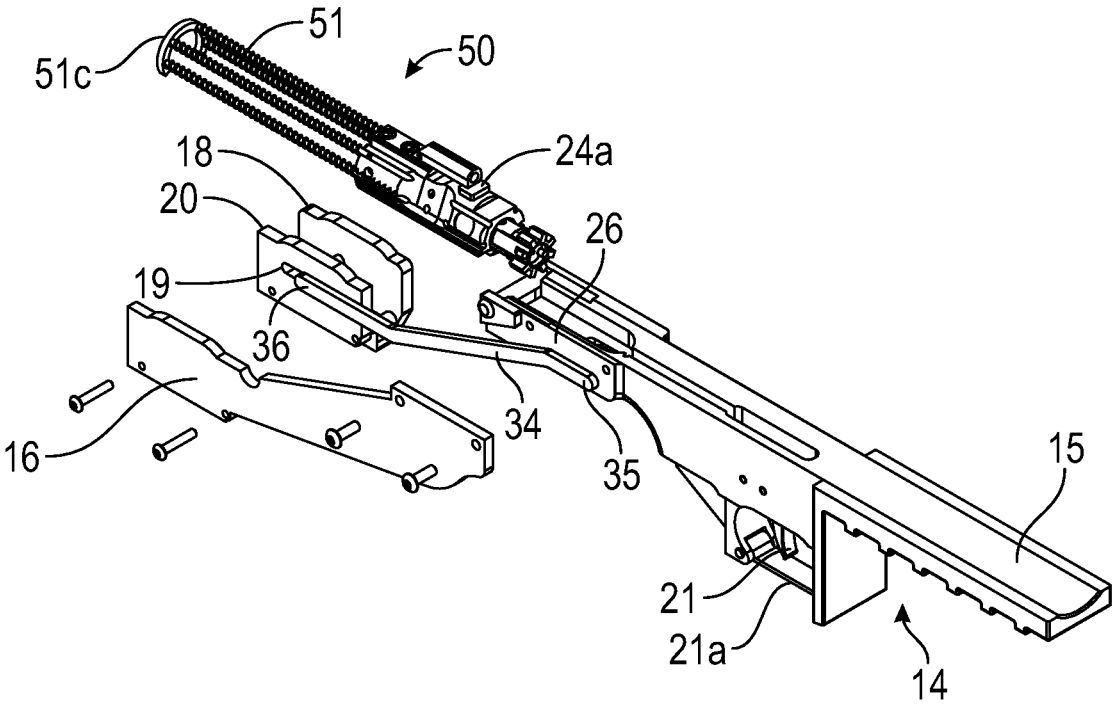
FIG. 4*b* is an exploded view of the bullpup assembly as in FIG. 4*a;*
Figure 8A:
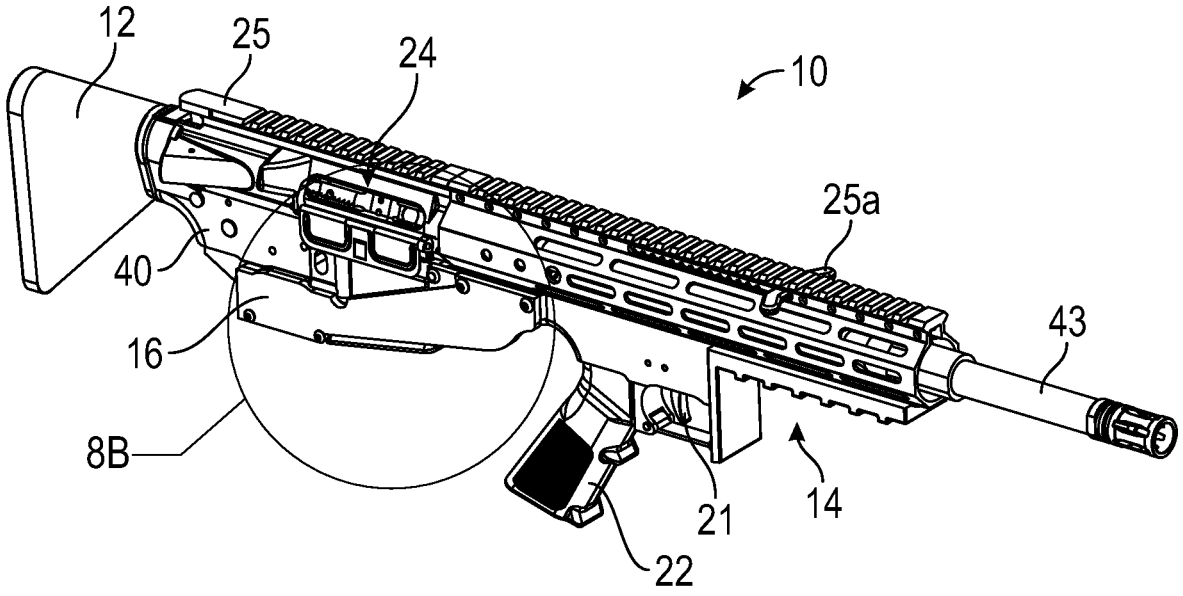
FIG. 8*a* is another is a perspective view of the bullpup assembly as in FIG. 1.
Figure 8B:
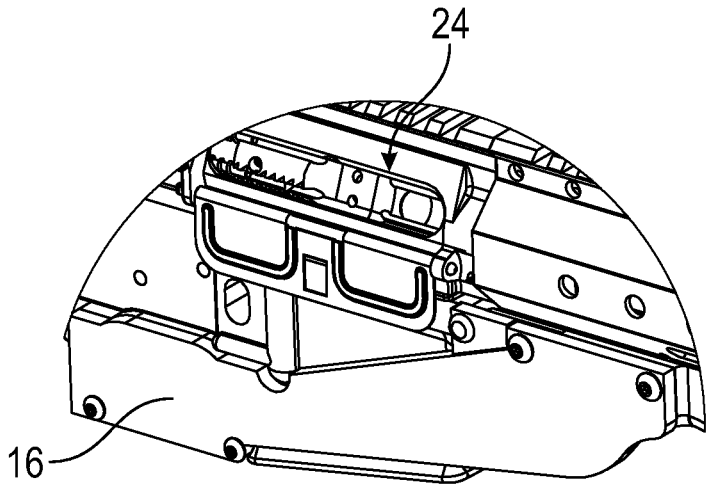
FIG. 8*b* is an isolated view on an enlarged scale taken from FIG. 8*a;*
Figure 9:
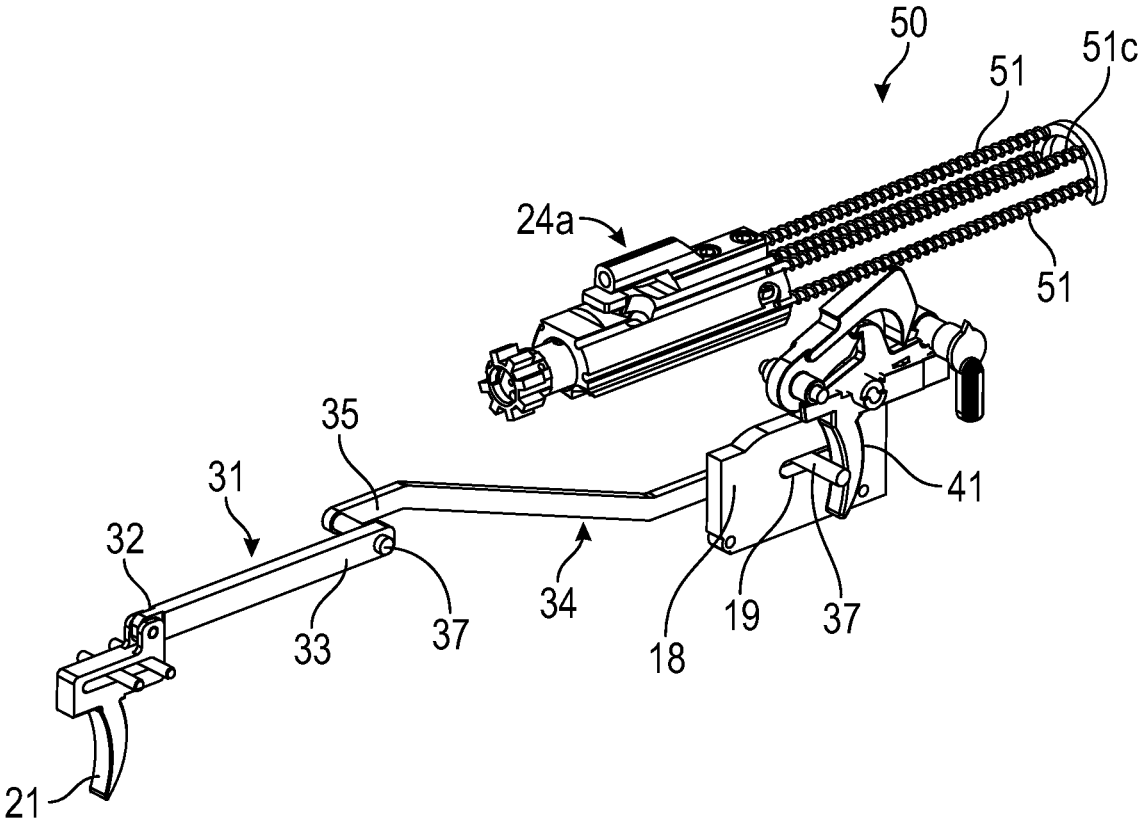
FIG. 9 is a perspective view of a trigger linkage removed from the bullpup assembly as in FIG. 1.

The bullpup receiver 14 may include a trigger handle 22 and bullpup trigger 21 (FIG. 8*a*). The trigger 21 may be protected from damage or accidental firing by a bullpup trigger guard 21*a*. In some embodiments, the bullpup handle 22 may have a pistol grip configuration that is ergonomic and easy to grip in a person's hand. Further, the bullpup kit 10 may include a trigger linkage 30 that operably connects the bullpup trigger 21 with the AR-15 trigger 41 in such a manner that when a user pulls the bullpup trigger 21, the stock AR-15 trigger 41 is pulled simultaneously so as to fire the AR-15 (FIGS. 7*a* to 9). More particularly, the bullpup linkage 30 may include a trigger link 31 having a proximal end 32 (also referred to as a link proximal end) coupled to the bullpup trigger 21, an opposed distal end 33 (also referred to as a link distal end) and has a linear configuration. The bullpup linkage 30 may also include a trigger bar 34 having a proximal end 35 (also referred to as a bar proximal end) coupled to the distal end 33 of the trigger link 31 and have a distal end 36 (also referred to as a bar distal end) operatively coupled to the AR-15 trigger 41 (FIG. 9). The trigger bar 34 may have an offset configuration. Even more particularly, the proximal end 32 of the trigger link 31 and the distal end 36 of the trigger bar 34 include connection pins 37, respectively, that extend away horizontally from the trigger link 31 and trigger bar 34, respectively, first for connecting the link and bar and to bear against the AR-15 trigger 41, respectively (FIG. 9). The connection pins 37 extend through slots 27 and 19, respectively, of respective guide plates 26 and 18 (FIGS. 4*b* and 5*b*).

Figure 3:
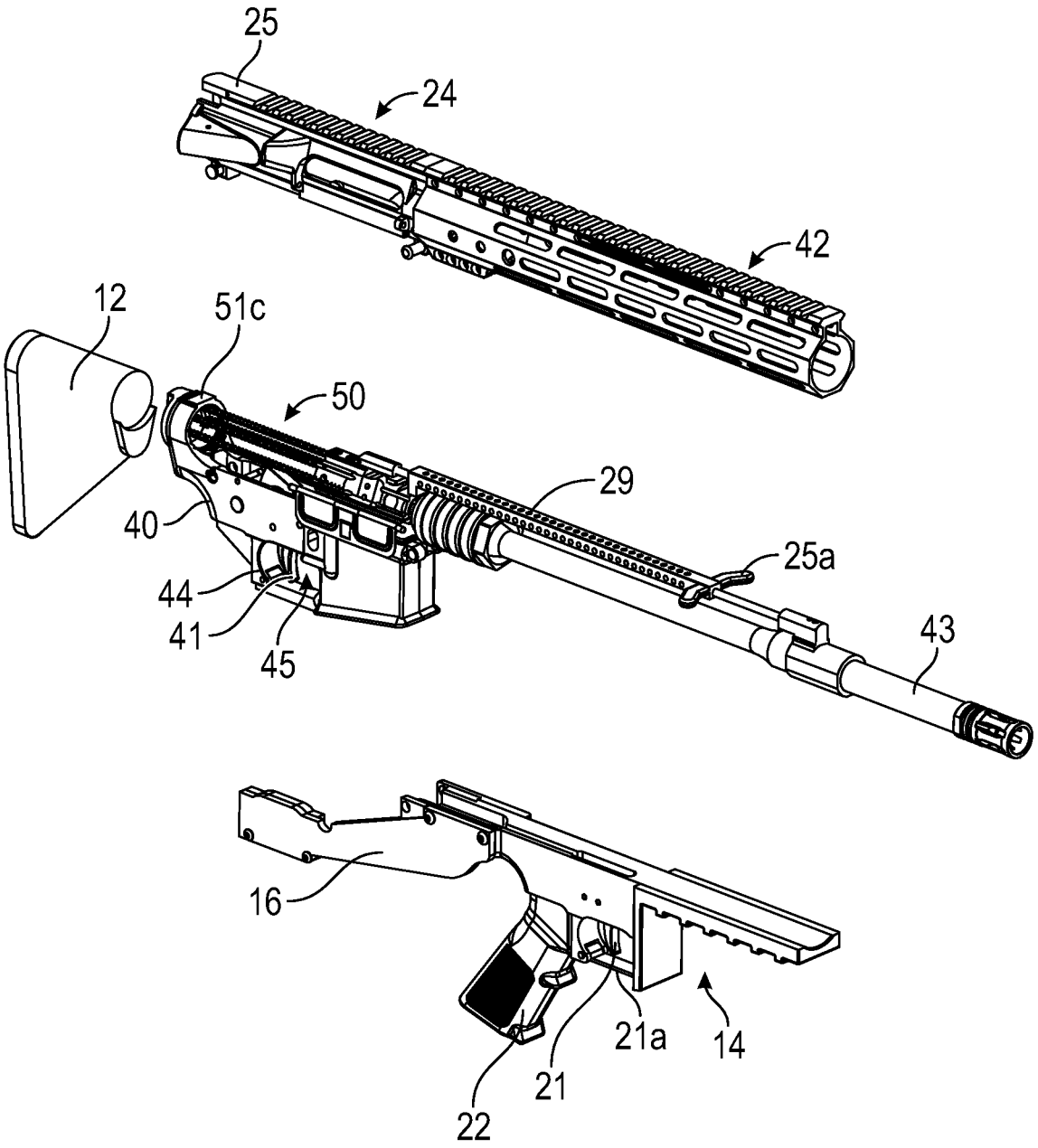
FIG. 3 is an exploded view of the bullpup assembly as in FIG. 1.

The bullpup kit 10 may include a bullpup guide plate 18 that may be attached to or integrally constructed with the bullpup trigger 21, the bullpup guide plate 18 defining what will be referred to as a bullpup trigger slot 19 through which a respective connection pin 37 extends. The connection pin 37 moves in the bullpup trigger slot 19 when the bullpup trigger 21 is actuated which causes the trigger linkage 30 to move rearward—actuating the AR-15 trigger 41 to fire the firearm. The standard AR-15 includes a guide plate 44 that is coupled to the body frame 40 and positioned proximate the AR-15 trigger 41 and that defines what will be referred to as an AR-15 guide slot 45 (FIG. 3). A respective connection pin 37 moves rearwardly in the AR-15 guide slot 45 and bears against the AR-15 trigger 41 when the trigger linkage 30 is actuated such that the AR-15 is fired. An auxiliary guide plate 26 may also be provided and which defines an auxiliary slot 27 configured to receive a connection pin 37 (FIG. 5*a*) for coupling the trigger link 31 and trigger bar 34 together (FIG. 5*a*).

Figure 5A:
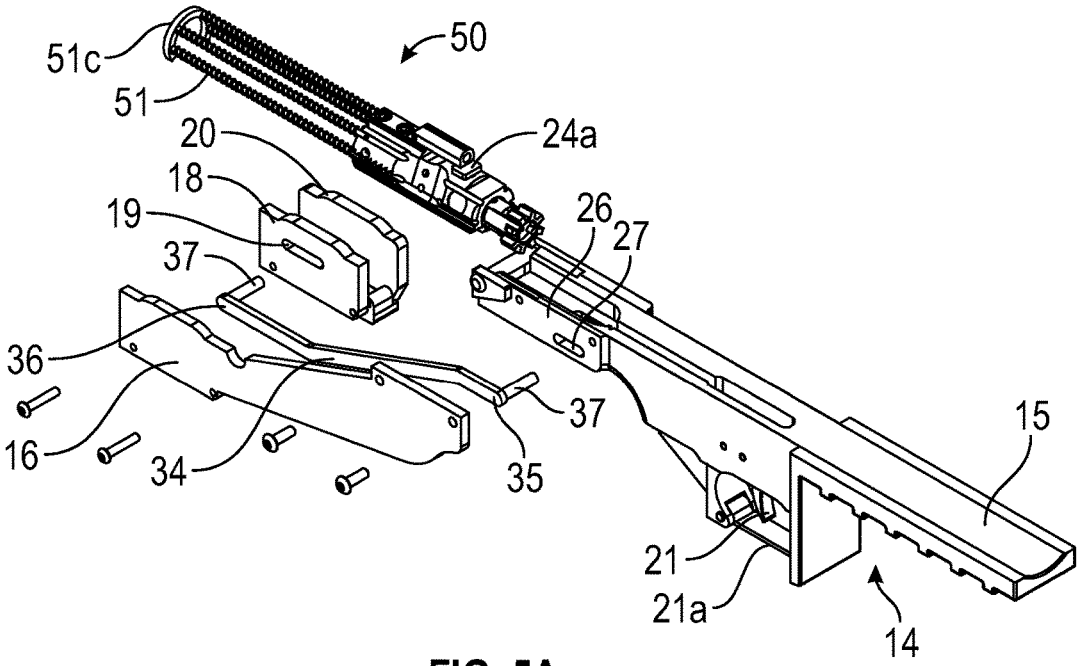
FIG. 5*a* is an exploded view of the bullpup assembly as in FIG. 4*a;*
Figure 5B:
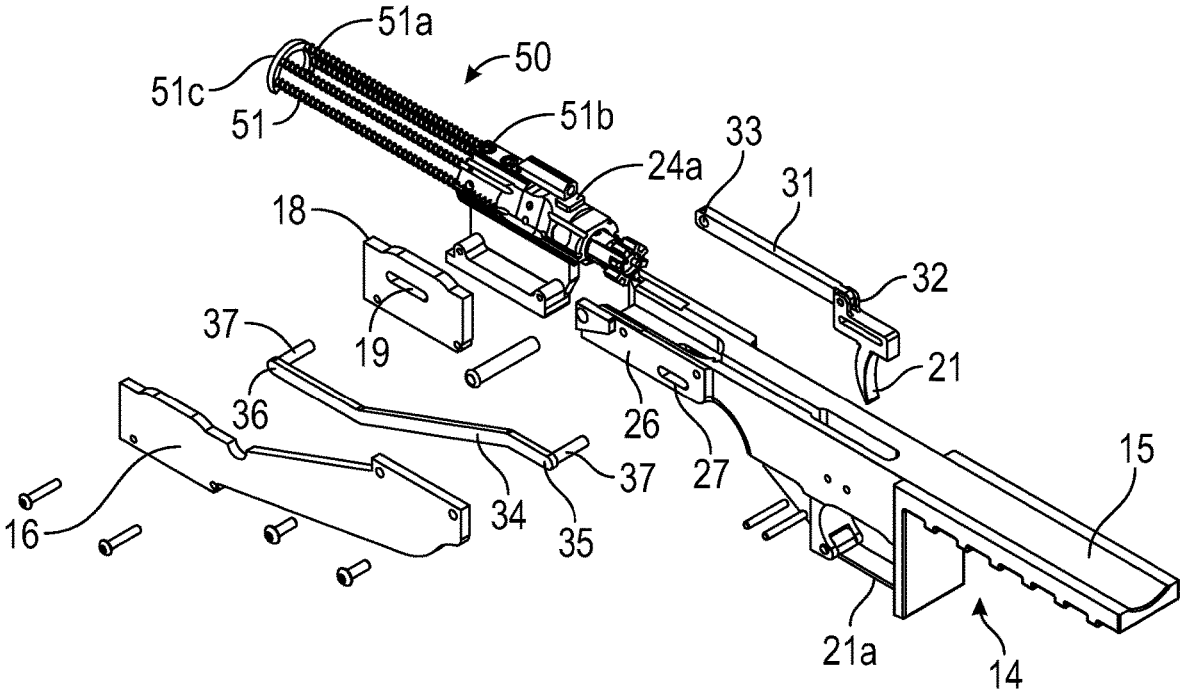
FIG. 5*b* is a further exploded view of the bullpup assembly as in FIG. 5*a;*
Figure 6A:
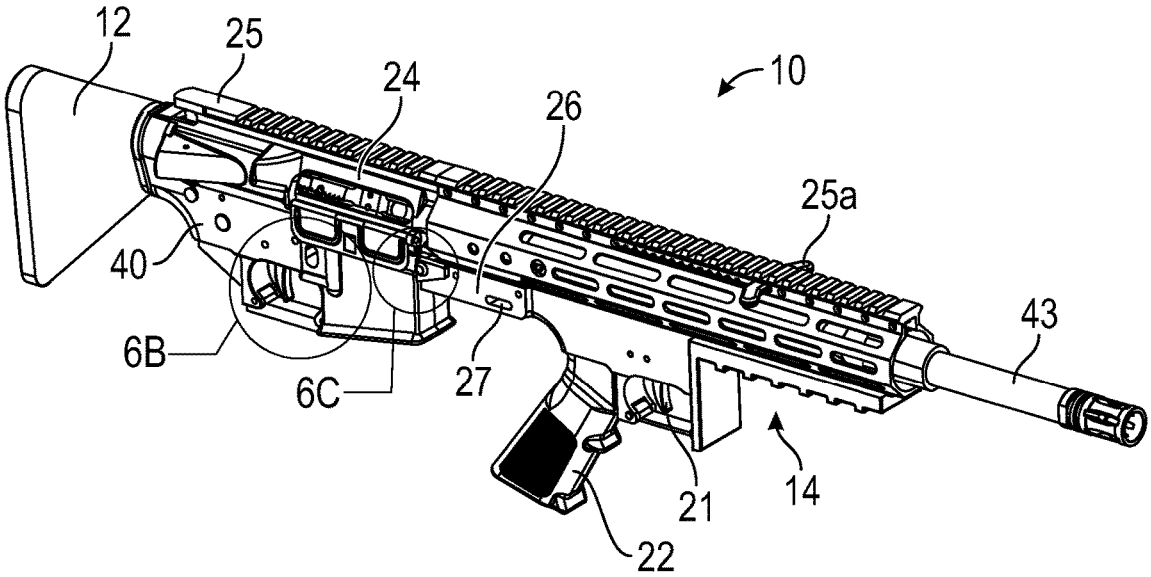
FIG. 6*a* is another perspective view of the bullpup assembly as in FIG. 1.
Figure 6B:
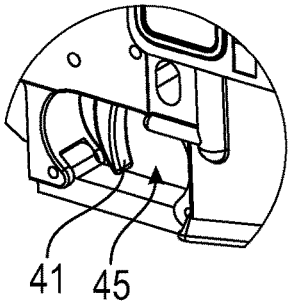
FIG. 6*b* is an isolated view on an enlarged scale taken from FIG. 6*a;*
Figure 6C:
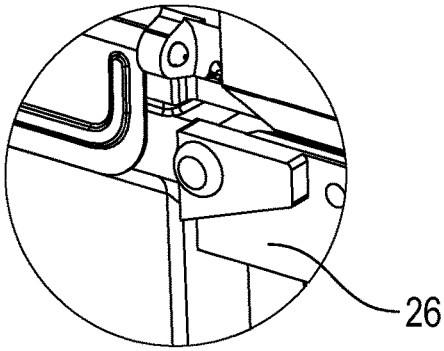
FIG. 6*c* is an isolated view on an enlarged scale taken from FIG. 6*a;*
Figure 7A:
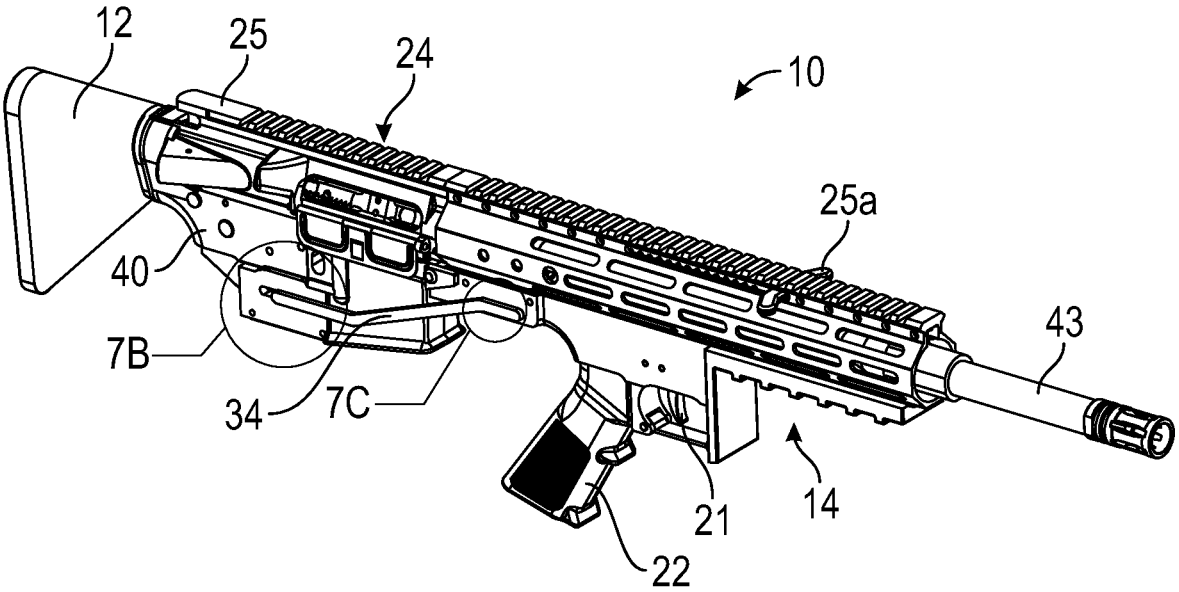
FIG. 7*a* is a perspective view of the bullpup assembly as in FIG. 1 with selected cover plates removed for clarity.
Figure 7B:
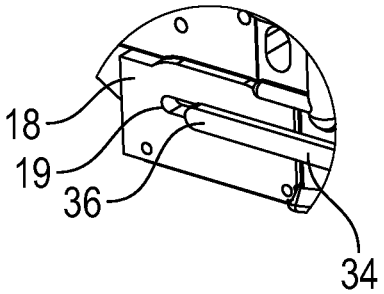
FIG. 7*b* is an isolated view on an enlarged scale taken from FIG. 7*a;*
Figure 7C:
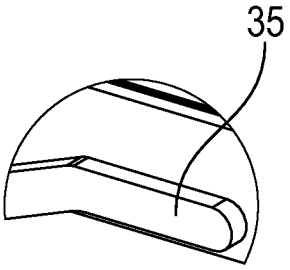
FIG. 7*c* is an isolated view on an enlarged scale taken from FIG. 7*a;*

The guide plate 18 and a trigger guard 20 essentially sandwich the AR-15 trigger 41 so as to shield it from damage and to prevent inadvertent actuation (FIG. 5*a*). In addition, the bullpup kit 10 may include a side plate 16 that may be coupled to the bullpup receiver 14 and is positioned to cover and protect the AR-15 trigger guide plate 44.

Figure 10A:
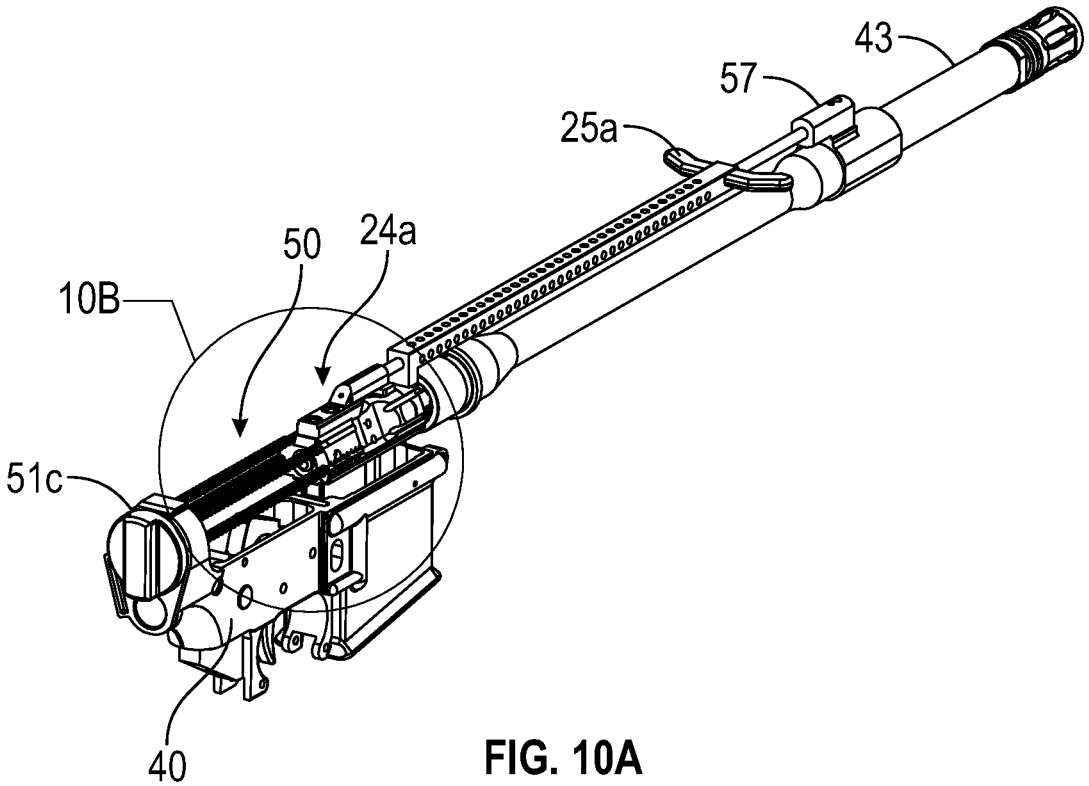
FIG. 10*a* is a perspective view of the bullpup assembly according to the present invention, illustrated removed from the lower receiver and with the bullpup bolt carrier group installed.

Now described in more detail, the bolt carrier group (BCG) 24 included in the bullpup kit 10 and which replaces the traditional bolt carrier group of the original AR-15 assembly is critical to the proper and superior functionality of the converted assembly of the bullpup configuration. Specifically, the bolt carrier group 24 includes an elongate forward charging handle 25*a* forward of the bullpup trigger 21 (FIG. 10*a*), actuation of which simultaneously operates the rear charging handle 25 so as to push the bullpup bolt carrier group 24 rearwardly to load a bullet from a magazine 48 into the chamber to be fired. The charging handle assembly is configured to ride along the stock gas tube 57 of the barrel assembly 42 (FIG. 10*a*).

The bullpup carrier group 24 includes carrier portion 24*a* and a spring assembly 50 having a plurality of compression springs 51 each having a distal end 51*a* seated in a ring-shaped flange referred to as a buffer plug 51*c* associated with the body frame 40 and a proximal end 51*b* that interfaces with the carrier portion 21*a* that slidably recoils to compress the springs 51, e.g., when a bullet is fired. The springs 51 are configured to compress toward the buffer plug 51*c* when the charging handle 25/charging arm 23 is pulled back and then to push the carrier member 24*a* forwardly when the charging handle 25 is released (which releases the tension on the springs). It should be noted that the modified AR-15 is able to accommodate and absorb the recoil of the carrier portion 24*a* without the standard buffer that would conventionally extend into the buttstock.

Figure 10B:
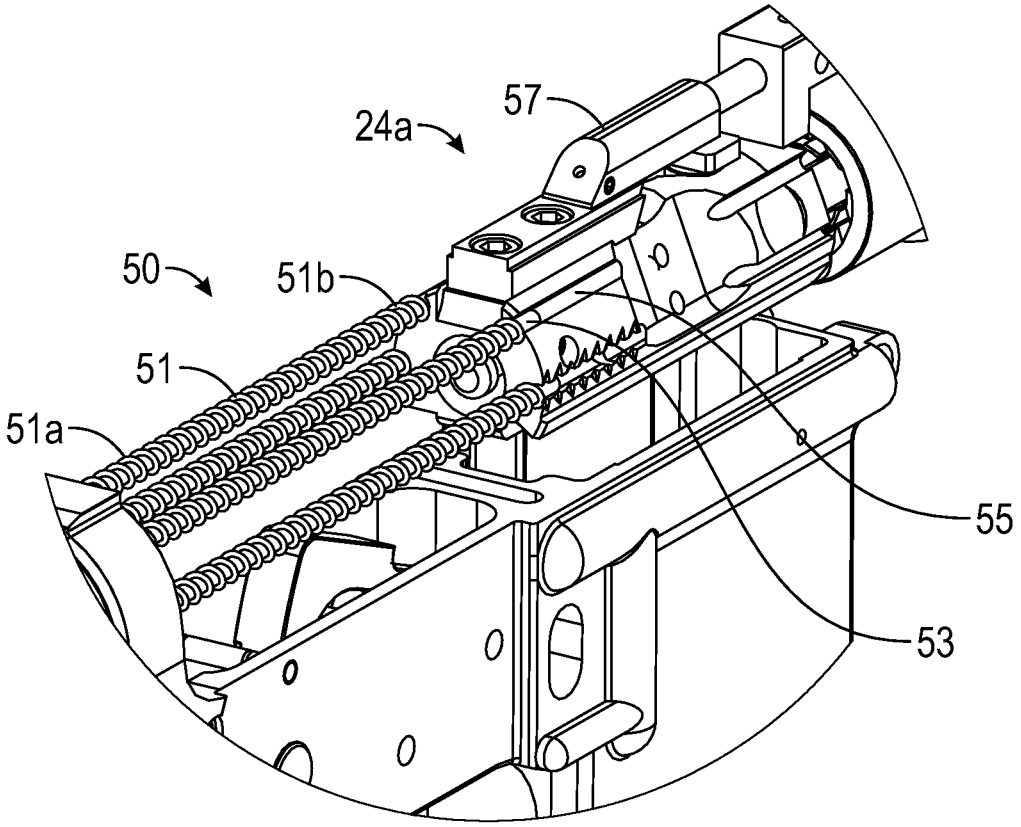
FIG. 10*b* is an isolated view on an enlarged scale taken from FIG. 10*a;*

Now, more particularly, the BCG 24 includes a plurality of guide rods 53 each extending longitudinally from buffer plug 51*c* forwardly in the direction of the carrier portion 24*a*. Each spring of said plurality of compression springs 51 are positioned loosely about the plurality of guide rods 53, respectively. While each guide rod 53 has a fixed length, each spring 51 is configured to compress when loaded and to expand/decompress when the load is removed. Further, the carrier portion 24*a* of the BCM 24 includes a casing having an outer surface that defines a plurality of grooves 55 (which may also be referred to as channels 55), the plurality of grooves 55 being radially spaced apart in a predetermined and perfect alignment with the plurality of guide rods 53. In operation, when the carrier portion 24*a* is moved rearwardly (such as when the charging arm 23 is pulled rearwardly), whether manually to talk the hammer 54 or when recoiling after firing a bullet, the plurality of guide rods 53 are configured to slide along the plurality of grooves 55, respectively while the associated plurality of springs 51 are compressed. This relationship is best shown in FIG. 10*b*.

Figure 12A:
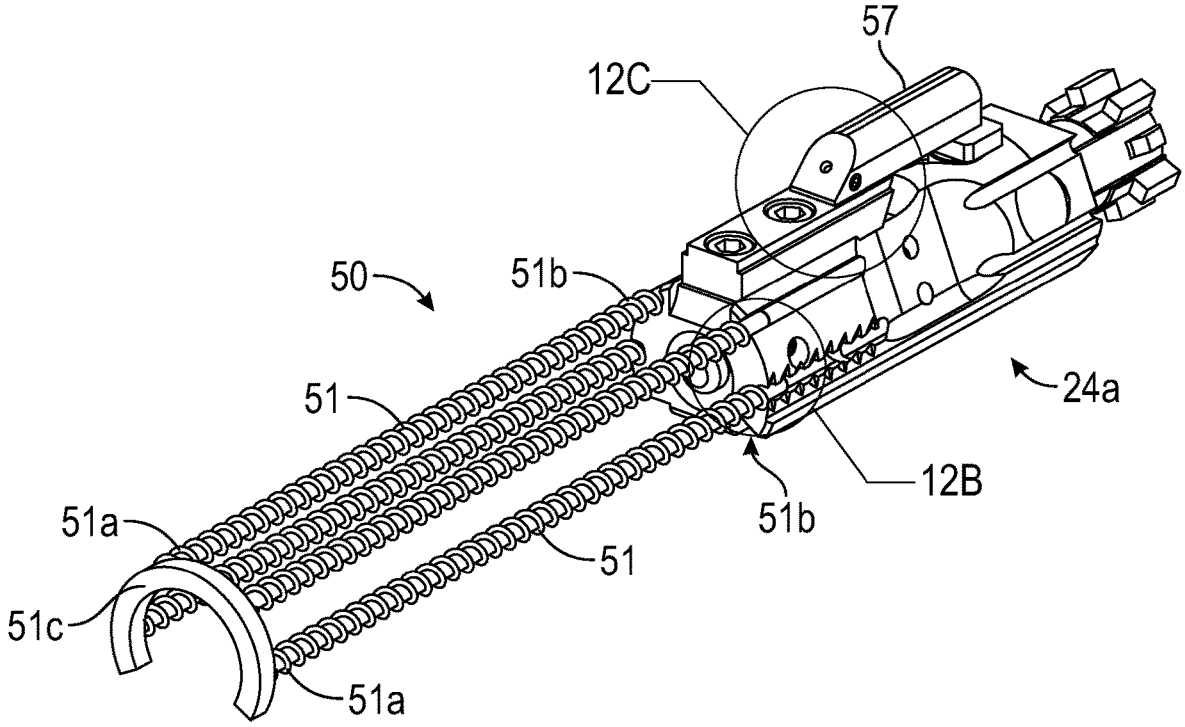
FIG. 12*a* is an isolated perspective view of the bolt carrier group removed from the bullpup assembly of FIG. 10*b;*
Figure 12B:
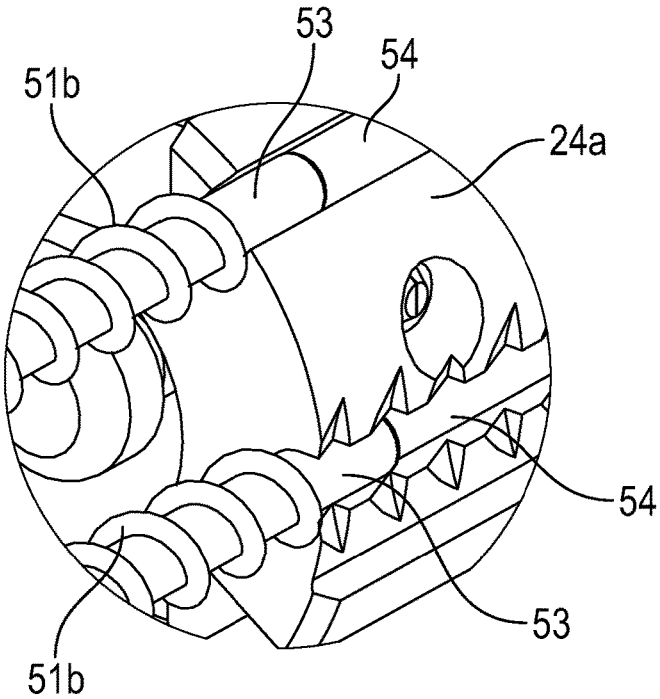
FIG. 12*b* is an isolated view on an enlarged scale taken from FIG. 12*a;*
Figure 12C:
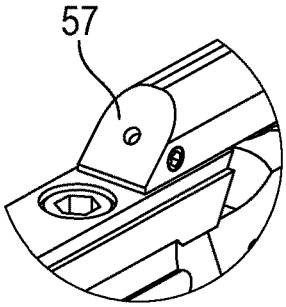
FIG. 12*c* is an isolated view on an enlarged scale taken from FIG. 12*a.*

Operation of the bolt carrier group (BCG) 24 may be described in detail as follows. To initiate operation, the charging handle 25 must be pulled rearwardly towards the stock 12 of the gun in alignment with the barrel. On the top of the BCG 24 there is a shelf which interfaces with the charging arm 23. Pulling the charging handle 25 rearwardly (using the forward 25*a* or rearward 25 handle), pulls the charging arm 23 rearwardly which pushes the carrier portion 24*a* rearwardly due to the interface between the charging arm 23 and carrier portion 24*a*. As the carrier portion 24*a* moves rearwardly, the coils of the buffer spring 51 are pulled into tension/compressed (FIG. 12*a*). The rearward motion of the carrier member 24*a* cocks the hammer 54 (FIG. 10*b*) of the trigger as the bottom of the carrier member 24*a* slides over the hammer 54. (by which, via the bullpup trigger linkage, the bullpup trigger 21 is simultaneously cocked), Once the charging handle has been pulled to the rear to its full extent, the charging arm 23 is released. At this point the coiled energy (compressed energy) from the spring 50 projects the carrier portion 24*a* forward. On its forward motion, the bolt strips the top round from the magazine 48 and it is pushed into the chamber (directed via feed ramps). At this time a cartridge 11 carrying a bullet round is chambered, the hammer is cocked and the weapon is ready to fire by pulling the bullpup trigger 21. Once the trigger has been pulled the hammer 54 strikes the firing pin, the firing pin striking the primer 49 of the cartridge 11 which ignites the powder in the cartridge 11. Burning gases from the spent cartridge may exit the barrel through gas tube 57 and relief valve, part of which is visible in FIG. 12*a* and operatively in communication with the barrel 43, push the carrier portion 24*a* rearward and the entire cycle is repeated.

Figure 13A:
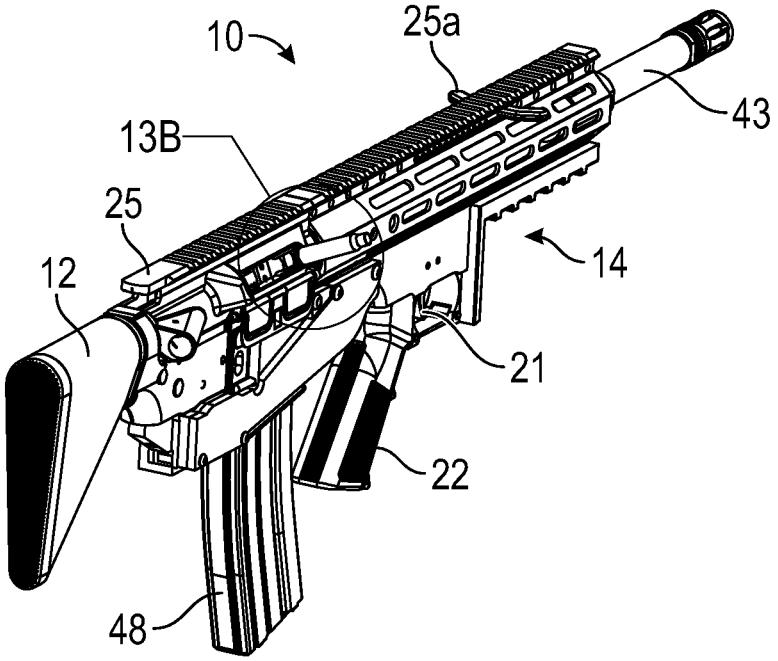
FIG. 13*a* is a rear perspective view of the bull pup assembly as in FIG. 1.
Figure 13B:
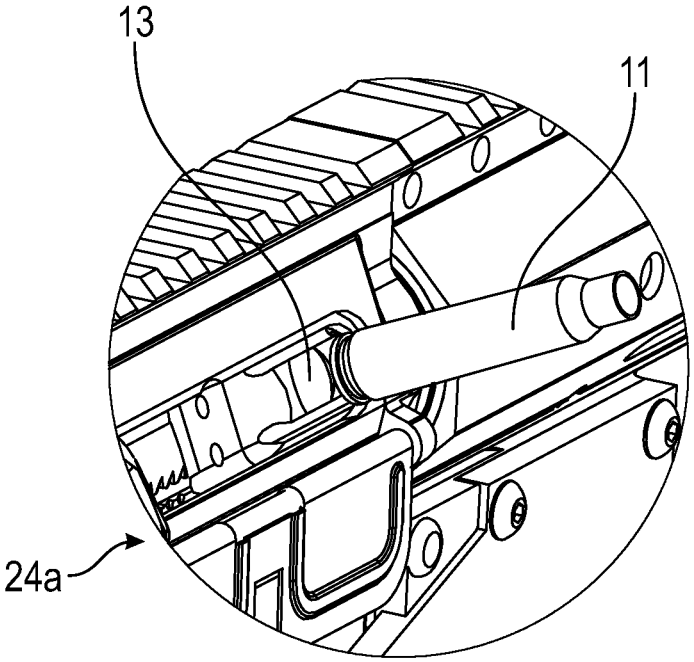
FIG. 13*b* is an isolated view on an enlarged scale taken from FIG. 13*a*.

In another aspect and as shown in FIGS. 13*a* and 13*b*, when the carrier member 24*a* is thrust rearward and then propelled forwardly as described above, a now empty cartridge 11 is ejected from the chamber and a new cartridge is loaded in preparation for the next shot. As is known by anyone who has fired virtually any type of firearm, a cartridge made jam inside the chamber, making the firearm and usable until the gyms cleared. To solve this problem, an interior surface of the chamber in the present invention defines a small depression 13 that is configured to receive a user's finger or tool in an action to loosen, pop out, or manually eject a jammed cartridge 11 (FIG. 13*b*).

Using the bullpup kit 10, a conventional AR-15 firearm 100 may be converted to a bullpup configuration. Specifically, the AR-15 firearm 100 is, in part, disassembled and such that components from the bullpup kit 10 may then be mounted to the AR-15 frame 40 that remains as described above. The method may be selectively reversed to return to the conventional AR-15 firearm 100 configuration—all without making any permanent modifications to the components of either assembly.

It is understood that while certain forms of this invention have been illustrated and described, it is not limited thereto except insofar as such limitations are included in the following claims and allowable functional equivalents thereof.

The invention claimed is:

1. A bullpup conversion kit for converting an AR-15 firearm of a type that includes a body member having an AR-15 standard trigger, a bolt carrier with a buffer tube mounted atop the body member, a standard shoulder stock coupled rearwardly to the body member, and a barrel assembly extending operatively forwardly from the bolt carrier, into a bullpup firearm, said bullpup conversion kit comprising:

a lower receiver coupled to a front portion of the body member, said lower receiver having a bullpup trigger situated forwardly from the standard trigger and an upper surface supporting the barrel assembly;

a bufferless bolt carrier assembly mounted atop the body member in replacement of the bolt carrier of the AR-15 firearm, said bufferless bolt carrier assembly including a bolt carrier and a spring assembly mounted in a buffferless space rearwardly of and in communication with said bolt carrier; and a trigger linkage coupled at one end to the bullpup trigger and coupled at another end to the standard trigger such that actuation of the bullpup trigger actuates the standard trigger via the trigger linkage.

2. The bullpup conversion kit as in claim 1, wherein said spring assembly includes:

a buffer plug having a ring-shaped configuration and coupled to the body member rearward of said bolt carrier;

a plurality of compression springs each including a distal end seated in said buffer plug and extending forwardly to a proximal end adjacent a rear end of said bolt carrier of said bufferless bolt carrier assembly, said plurality of compression springs being radially spaced apart from one another.

3. The bullpup conversion kit as in claim 2, wherein:

said bolt carrier is slidably movable relative to the body member between a first configuration displaced from said buffer plug and a second configuration proximate said buffer plug;

said plurality of compression springs are compressed by rearward contact with said bolt carrier when said bolt carrier is moved toward said first configuration and are decompressed when said bolt carrier is moved toward said second configuration.

4. The bullpup conversion kit as in claim 2 wherein said plurality of compression springs receive tension energy when a load is applied by rearward movement of the bolt carrier and release said received tension energy so as to push said bolt carrier forwardly when said load is released.

5. The bullpup conversion kit as in claim 3, wherein:

said bolt carrier has an outer surface that defines a plurality of groove each having a longitudinal orientation and spaced apart radially from one another;

said bolt carrier assembly includes as plurality of guide rods each having a fixed length and linear configuration with a first end seated in said buffer plug and a second end aligned for slidable movement along said plurality of grooves, respectively, as said bolt carrier is moved between said first and second configurations;

said plurality of compression springs are radially positioned about and guided by said plurality of said guide rods, respectively.

6. The bullpup conversion kit as in claim 1, wherein said lower receiver includes a guide plate and a guard plate being parallel to one another and positioned adjacent opposite sides of the standard trigger so as to prevent unintended actuation thereof, said guide plate defining a guide slot in communication with said trigger linkage.

7. The bullpup conversion kit as in claim 3, wherein said trigger linkage includes:

a trigger link having a link proximal end operatively coupled to the bullpup trigger and having a link distal end opposite said link proximal end;

a trigger bar having a bar proximal end operatively coupled to said link distal end and a bar distal end operatively coupled to the standard trigger such that actuation of the bullpup trigger simultaneously actuates the standard trigger.

8. The bullpup conversion kit as in claim 1, further comprising a bullpup stock coupled to a rear of the body member when the standard shoulder stock associated with the AR-15 firearm is removed.

9. The bullpup conversion kit as in claim 1, further comprising a charging arm in communication with the bolt carrier and operative, when pulled rearwardly, to move said bolt carrier toward said second configuration proximate said bufferless plug;

wherein said charging arm includes a rear charging handle and a forward charging handle, either of which enabling a user to manually actuate said bolt carrier.

10. The bullpup conversion kit as in claim 1, wherein said bolt carrier defines a chamber through which a cartridge is translated from a magazine into a barrel associated with the bullpup firearm defines a recessed area by which a jammed cartridge is pried loose.

11. A method for converting an AR-15 firearm into a bullpup firearm using a bullpup conversion kit, said method for converting comprising:

removing a standard shoulder stock and a standard bolt carrier group from a body member of the AR-15 firearm;

mounting a lower receiver to a front portion of the body member, said lower receiver having a bullpup trigger situated forwardly from a standard trigger associated with the AR-15 firearm and having an upper surface supporting a barrel assembly associated with the AR-15 firearm;

mounting a bufferless bolt carrier assembly atop the body member in replacement of the bolt carrier group of the AR-15 firearm, said bufferless bolt carrier assembly including a bolt carrier and a spring assembly mounted in a buffferless space rearwardly of and in communication with said bolt carrier;

mounting a trigger linkage at one end to the bullpup trigger and at another end to the standard trigger such that actuation of the bullpup trigger actuates the standard trigger via the trigger linkage.

12. The method for converting as in claim 11, wherein said spring assembly includes:

a buffer plug having a ring-shaped configuration and coupled to the body member rearward of said bolt carrier;

a plurality of compression springs each including a distal end seated in said buffer plug and extending forwardly to a proximal end adjacent a rear end of said bolt carrier of said bufferless bolt carrier assembly, said plurality of compression springs being radially spaced apart from one another.

13. The method for converting as in claim 12, further comprising:

slidably moving said bolt carrier relative to the body member between a first configuration displaced from said buffer plug and a second configuration proximate said buffer plug;

wherein said plurality of compression springs are compressed by rearward contact with said bolt carrier when said bolt carrier is moved toward said first configuration and are decompressed when said bolt carrier is moved toward said second configuration.

14. The method for converting as in claim 12 wherein said plurality of compression springs receives tension energy when a load is applied by rearward movement of the bolt carrier and released said received tension energy so as to push said bolt carrier forwardly when said load is released.

15. The method for converting as in claim 13, wherein:

said bolt carrier has an outer surface that defines a plurality of groove each having a longitudinal orientation and spaced apart radially from one another;

said bolt carrier assembly includes as plurality of guide rods each having a fixed length and linear configuration with a first end seated in said buffer plug and a second end aligned for slidable movement along said plurality of grooves, respectively, as said bolt carrier is moved between said first and second configurations;

said plurality of compression springs are radially positioned about and guided by said plurality of said guide rods, respectively.

16. The method for converting as in claim 11, wherein said lower receiver includes a guide plate and a guard plate being parallel to one another and positioned adjacent opposite sides of the standard trigger so as to prevent unintended actuation thereof, said guide plate defining a guide slot in communication with said trigger linkage.

17. The method for converting as in claim 13, wherein said trigger linkage includes:

a trigger link having a link proximal end operatively coupled to the bullpup trigger and having a link distal end opposite said link proximal end;

a trigger bar having a bar proximal end operatively coupled to said link distal end and a bar distal end operatively coupled to the standard trigger such that actuation of the bullpup trigger simultaneously actuates the standard trigger.

18. The method for converting as in claim 11, further comprising a bullpup stock coupled to a rear of the body member when the standard shoulder stock associated with the AR-15 firearm is removed.

19. The method for converting as in claim 11, further comprising mounting a charging arm atop the bolt carrier that is operative, when pulled rearwardly, to move said bolt carrier toward said second configuration proximate said bufferless plug;

wherein said charging arm includes a rear charging handle and a forward charging handle, either of which enabling a user to manually actuate said bolt carrier.

20. The method for converting as in claim 11, wherein said bolt carrier defines a chamber through which a cartridge is translated from a magazine into a barrel associated with the bullpup firearm defines a recessed area by which a jammed cartridge is pried loose.

* * * * *